US008122933B2

(12) United States Patent
Rieder et al.

(10) Patent No.: US 8,122,933 B2
(45) Date of Patent: Feb. 28, 2012

(54) SECTIONAL DOOR

(75) Inventors: Franz-Wilhelm Rieder, Bocholt (DE); Marco Göckus, Kruetzal (DE); Stefan Höfling, Rees (DE)

(73) Assignee: Novoferm GmbH, Rees (DE)

( * ) Notice: Subject to any disclaimer, the term of this patent is extended or adjusted under 35 U.S.C. 154(b) by 1400 days.

(21) Appl. No.: 11/288,682

(22) Filed: Nov. 29, 2005

(65) Prior Publication Data

US 2006/0076114 A1 Apr. 13, 2006

Related U.S. Application Data

(63) Continuation of application No. 10/755,485, filed on Jan. 12, 2004, now Pat. No. 7,048,029.

(30) Foreign Application Priority Data

Mar. 22, 2003 (DE) ..... 103 12 904
Oct. 25, 2003 (DE) ..... 103 49 904

(51) Int. Cl.
*E05D 15/16* (2006.01)

(52) U.S. Cl. ..... 160/188; 160/201; 49/358; 104/202

(58) Field of Classification Search ..... 160/188, 160/191, 192, 193; 49/358; 104/202, 233, 104/236, 172.1, 230; 105/73, 150
See application file for complete search history.

(56) References Cited

U.S. PATENT DOCUMENTS

| | | | |
|---|---|---|---|
| 3,012,520 | A | 12/1961 | Curtis |
| 4,625,456 | A | 12/1986 | Lafontaine |
| 5,036,899 | A | 8/1991 | Mullet |
| 5,343,923 | A | 9/1994 | Keller |

FOREIGN PATENT DOCUMENTS

| | | | |
|---|---|---|---|
| DE | 35 38 947 | | 5/1987 |
| DE | 41 23 575 | | 1/1993 |
| EP | 1176280 | * | 7/2000 |

OTHER PUBLICATIONS

EN 12453:2000, DIN Deutsches Institut für Normung e. V., Feb. 2001.

* cited by examiner

*Primary Examiner* — Blair M. Johnson
(74) *Attorney, Agent, or Firm* — Collard & Roe, P.C.

(57) ABSTRACT

A sectional door having a door frame, a door panel comprising sections coupled to another in articulated manner, a weight equalization device coupled to the door panel, and an electrical door drive for opening and closing movements of said door panel. The uppermost section in the closed position of the door panel, is guided on running rails as the header section, wherein said rails extend essentially horizontally up to the door frame, and have a vertical end segment on the frame side. The other sections that follow below the header section are guided in guide rails that have a vertical segment along the door frame, a horizontal segment parallel to the running rail that holds the header section, and an arc that joins the two segments. With this device, the door drive is attached to one of the sections connected below the header section, and has at least one power take-off shaft having an impeller at the end. The driven impeller engages in the guide rail and moves the door panel.

6 Claims, 7 Drawing Sheets

SECTIONAL DOOR

CROSS REFERENCE TO RELATED APPLICATIONS

This application is a continuation of application Ser. No. 10/755,485, filed Jan. 12, 2004 now U.S. Pat. No. 7,048,029, claims priority under 35 U.S.C. §119 of German Application No. 103 12 904.9 filed Mar. 22, 2003 and German Application No. 103 49 904.0 filed Oct. 25, 2003.

BACKGROUND OF THE INVENTION

1. Field of the Invention

The invention relates to a sectional door which can be used as a sliding garage door having a door frame, a door panel comprising of sections connected with one another in articulated manner, a weight equalization device connected with the door panel, and an electrical door drive for opening and closing movements of the door panel.

In the uppermost section, in the closed position, the door panel is guided on running rails as the header section. These rails extend essentially horizontally up to door frame, and have a vertical end segment on the frame side. In addition, the other sections that follow below the header section are guided in guide rails that extend vertically along the door frame. There is also a horizontal segment that extends to the running rail that holds the header section, as well as an arc that joins the two segments.

Sectional doors of the type described initially must satisfy the safety requirements described in the European standard EN 12453:2000. This standard requires that during an opening or closing process of the door panel, there can be a maximum dynamic force between the closing edges. However, such high forces are only permitted for a maximum period of time of 0.75 seconds. After this time span has elapsed, no static force is allowed that amounts to more than 150 N.

In the case of the sectional doors known from practice, having the characteristics described initially, a tolerated static force of 150 N is frequently exceeded during a regular opening or closing movement of the door panel. This force is within the permissible time frame, for a short period of time, so that high-power door drives can be used. If the required force for moving the door panel amounts to more than 150 N over a time period of more than 0.75 s, the door drive must be shut off by means of an emergency shut-off. If the emergency shut-off malfunctions, there is a significant risk of injury. It is also a problem that the drive, which is attached to the uppermost door panel section within the framework of the known measures, is located far from the hazard location, namely the lower closing edge. Thus, a long flow of force is present from the motor, via of the sections that are connected with one another in articulated manner, to the hazard location. A reduction in the drive force of the motor therefore only results in a corresponding relief of force at the hazard location after a certain delay.

The comparatively high power requirement during the opening and closing movements of these known sectional doors is due to many circumstances. For example, the header section of the door panel has a roller on both sides, in each instance, which is guided in a horizontal running rail assigned to it. The horizontal running rails have with it a vertical end segment on the frame side, in which the rollers of the uppermost section are drawn during a closing movement of the door panel. The rollers that are introduced into the vertical end pieces secure the header section in the door panel closing position, to prevent unauthorized opening from the outside. During an opening movement of the door panel, the rollers of the header section must first overcome a vertical distance before they get into the horizontal region of the running rail. This lifting movement at the beginning of the opening movement of the door panel presents a technical problem for the electrical door drive.

2. The Prior Art

A sectional door having the characteristics described initially is known from EP-A 1 176 280. The electrical door drive can be moved along a horizontal running rail and is connected with the header section via a coupling rod. In the closed position of the door panel, the coupling rod is aligned at a slant relative to the plane of the door panel. The tensile force transferred by means of the coupling rod during an opening movement of the door panel possesses both a horizontal and a vertical component. As a result of the vertical component, the roller of the header section can be drawn out of the vertical end segment of the vertical running rail with a travel movement of the door drive. However, high-power door drives are required, which have the hazard potential already described. This design has another disadvantage, that the header section is exposed to great lateral forces in the closed position of the door panel, and the vertical end segment of the running rail is exposed to great lateral forces at the beginning of an opening movement.

The invention is designed to reduce the risk of injury over previous designs. Thus, this invention uses a door drive to introduce a force to the door panel wherein the force is to be assured in every position of the door panel during an opening and closing movement.

To create this force, the invention relates to a door drive that is attached to one of the sections connected below the header section, and has at least one power take-off shaft mounted on the section. This shaft has an impeller at the end, wherein the driven impeller engages in the guide rail of the section and moves the door panel.

The door drive is rigidly mounted on the inside surface of a section of the door panel, and drives an impeller that engages in a guide rail that guides the sections. The guide rail has a vertical segment along the door frame, a horizontal segment parallel to the running rail that guides the header section, and an arc that joins the two segments. During a closing movement of the door panel, the driven impeller runs into the vertical segment of the guide rail. During a subsequent opening movement, the rollers of the header section are lifted out of the cropped end regions of the horizontal running rail, via the displacement movement of the driven impellers, which is at first, a vertical movement. Thus, relatively weak door drives can be used, because of the advantageous introduction of force, to reduce the risk of injury during an opening and closing movement of the door panel.

In a preferred embodiment of the invention, the door drive is attached to the lowermost section, in the door panel closing position. As compared to the designs known in the art, this design clearly reduces the force required to move the door panel after the rollers of the header section have been lifted out of the cropped end region of the horizontal running rail. Because of the arrangement of the door drive on the lowermost section in the door panel closing position, there is a short power flow between the door drive and the potential hazard location at the bottom closing edge of the door panel. Thus, the shut-off of the door drive results in very rapid relief of stress at the hazard location.

The door drive, in a preferred embodiment, is dimensioned so that the maximal drive force for moving the door panel is not more than 150 N. If two or more motors are arranged, dimensioning takes place accordingly, so that the total maximal drive force lies below the stated limit value. Thus, with a design that relates to the present invention, the stated critical force values of more than 150 N are not achieved during the regular opening or closing process of a door panel that has standard dimensions for a garage with one or two car parking spaces. Thus, the function of the door panel is assured even with the reduced drive output of the door drive. Therefore, the dynamic force range between 150 N and 400 N, within which there is a high risk of injury, as explained initially, is never reached. It is now not necessary to have an emergency shut-off, which shuts the power off, if the critical value of 150 N is exceeded over a period of more than 0.75 s.

Alternatively, the emergency shut-off can be set to a lower force limit value. Furthermore, the additional advantage is that there is also a reduced cost resulting from the use of a smaller door drive.

The door drive can have a bifurcation gear mechanism for two power take-off shafts that extend to both sides of the sections and wherein these shafts have impellers that engage in the guide rails at their ends. It is also possible to have a door drive with only one power take-off shaft, in each instance, which is disposed at one or both sides of the door panel. It is practical if the guide rails possess a C-shaped cross-sectional profile, whereby one shank of the profile is configured as a groove-shaped running surface and the other shank forms a support surface arranged at a distance from the running surface.

There are several design possibilities for assuring operationally reliable progressive movement of the driven impeller in the guide rail. These will be explained in the following paragraphs.

A first design embodiment provides that a spring-loaded tensioning device having at least one pressure roller supported on the support surface of the guide rail is arranged at the end of the power take-off shaft. This device presses the driven impeller against the running surface of the guide rail. The tensioning device can comprise two pivot arms mounted to rotate about the power take-off shaft, and which are connected by means of a tension spring. A pressure roller is thereby coupled to each of the pivot arms. This driven impeller should also have a rubber tire.

In a second preferred embodiment of the invention, the driven impeller works together with a flexible power transmission train. In this embodiment, guide rollers can be disposed in front of, and/or behind the driven impeller. This position can be seen in the opening movement direction, which press the driven impeller against the power transmission train, so that the power transmission train partly loops around the driven impeller. For example, a guide roller can be disposed in front of or behind the driven impeller, so that the power transmission train loops around the driven impeller in Z shape. In this case, tensioning stations are practical at both ends of the power transmission train, to maintain the tension during an opening and closing process of the door panel. Furthermore, guide rollers can be disposed in front of and behind the driven impeller, so that the power transmission train loops around the driven impeller in a loop shape. In this case, a tensioning station only has to be disposed at one end of the power transmission train.

There are also various possibilities for a structural design of the driven impeller and the power transmission train. The driven impeller can be configured as a pinion, which meshes with a power transmission train configured as a toothed belt or chain. Alternatively, the driven impeller can also have a U-shaped running surface that is delimited by side flanks, whereby then it is practical if the power transmission train is configured as a cable. Furthermore, it is also possible that the power transmission train is structured as a bead chain that comprises of a core and a plurality of bodies attached to the core at equal intervals, and wherein the driven impeller has a U-shaped running surface delimited by side flanks, which comprise depressions adapted to the bodies of the bead chain in the bottom of the running surface.

BRIEF DESCRIPTION OF THE DRAWINGS

In the following, the invention will be explained using the drawings that merely represent an exemplary embodiments. The drawings schematically show.

DETAILED DESCRIPTION OF PREFERRED EMBODIMENTS

Figure 1:
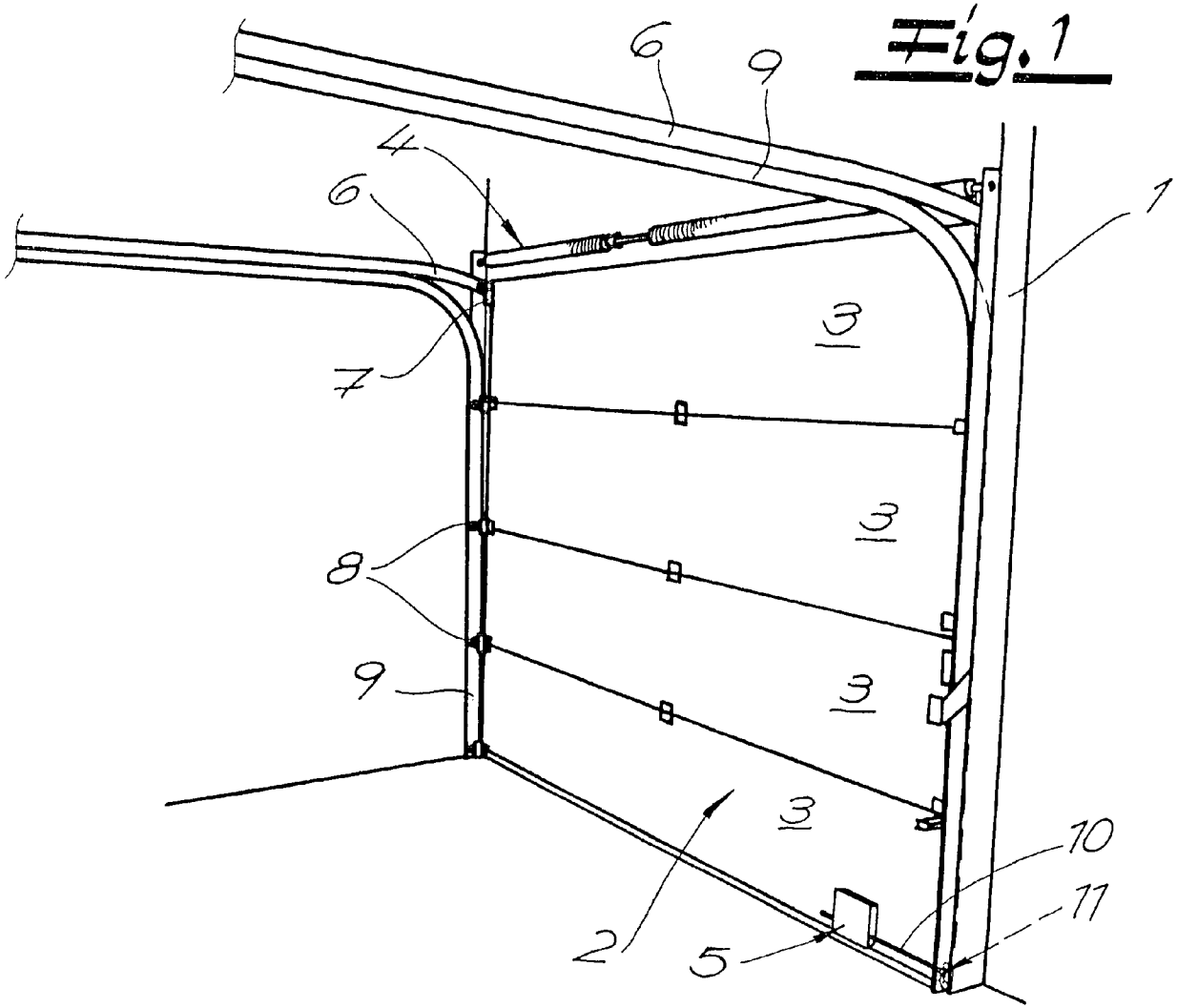
FIG. 1 is the inside view of a sectional door according to the invention, in a perspective view.
Figure 3:
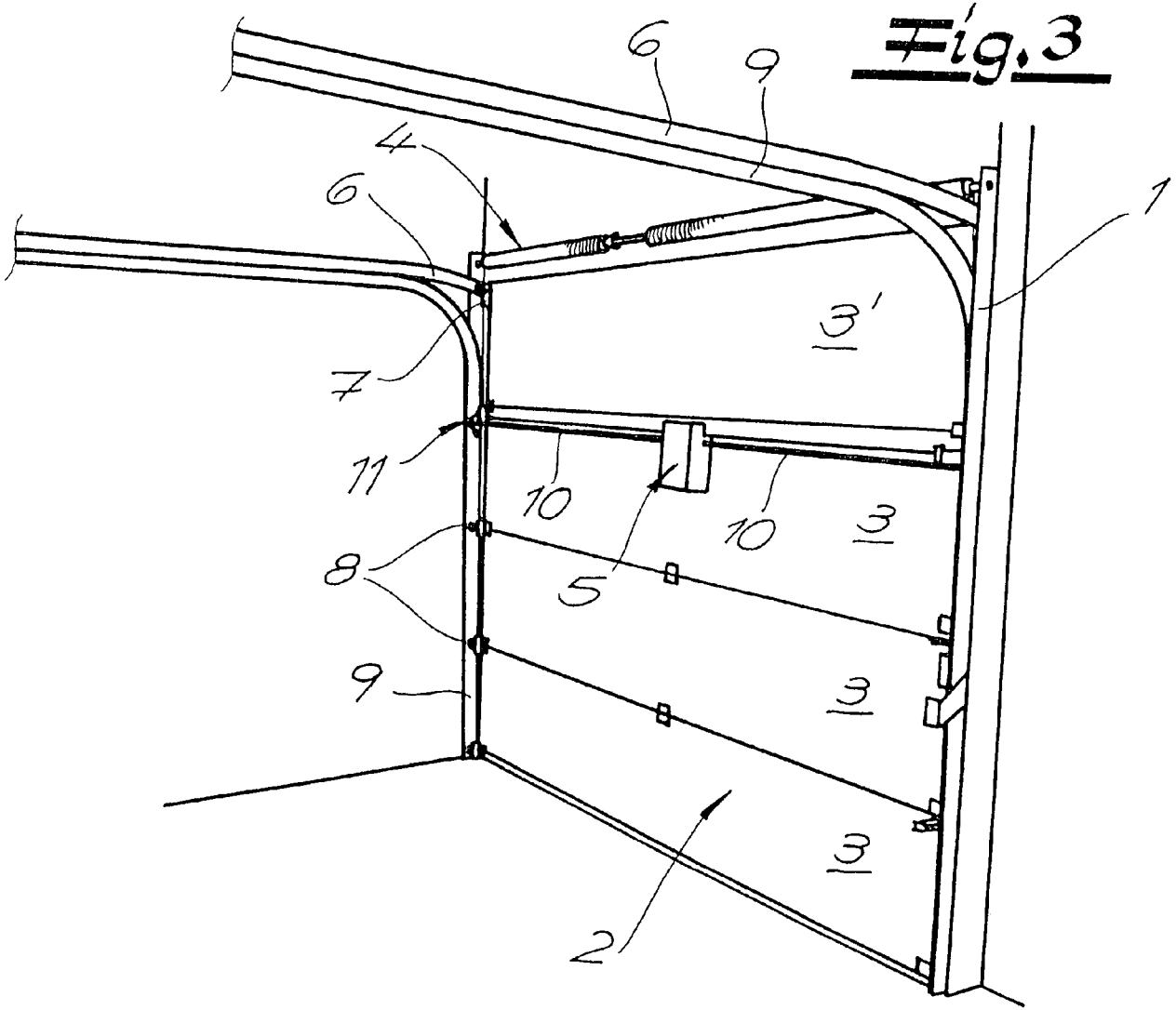
FIG. 3 is another embodiment of the invention.

Referring in detail to the drawings, the sectional door shown in FIGS. 1 and 3, in its fundamental structure, comprises a door frame 1, a door panel 2 composed of sections 3, 3' connected with one another in articulated manner, a weight equalization device 4 connected with door panel 2, and an electrical door drive 5 for opening and closing movements of door panel 2. In the present embodiment, weight equalization device 4 is configured as a torsion spring that is connected with the bottom section of the door panel by way of tension cables.

The uppermost section, in the closed position of the door panel, is guided on running rails 6 as header section 3'. Rails 6 extend essentially horizontally up to door frame 1, and have a vertical end segment 7 on the frame side. The other sections 3 that follow below header section 3' are guided, by rollers 8, in guide rails 9 that have a vertical segment along door frame 1, a horizontal segment parallel to running rail 6 that holds header section 3', as well as an arc that joins the two segments.

In the embodiment of FIG. 1, door drive 5 is preferably attached at the side of lowermost section 3, and has a power take-off shaft 10 mounted on section 3, with an impeller 11 at the end. Driven impeller 11 engages in guide rail 9 and moves door panel 2. In the embodiment of FIG. 3, door drive 5 has a bifurcation gear mechanism for two power take-off shafts 10, which extend to two sides of section 3 and have impellers 11 that engage in guide rails 9 at the sides. The door drive is then arranged on one of the sections 3 connected below header section 3'.

Figure 2:
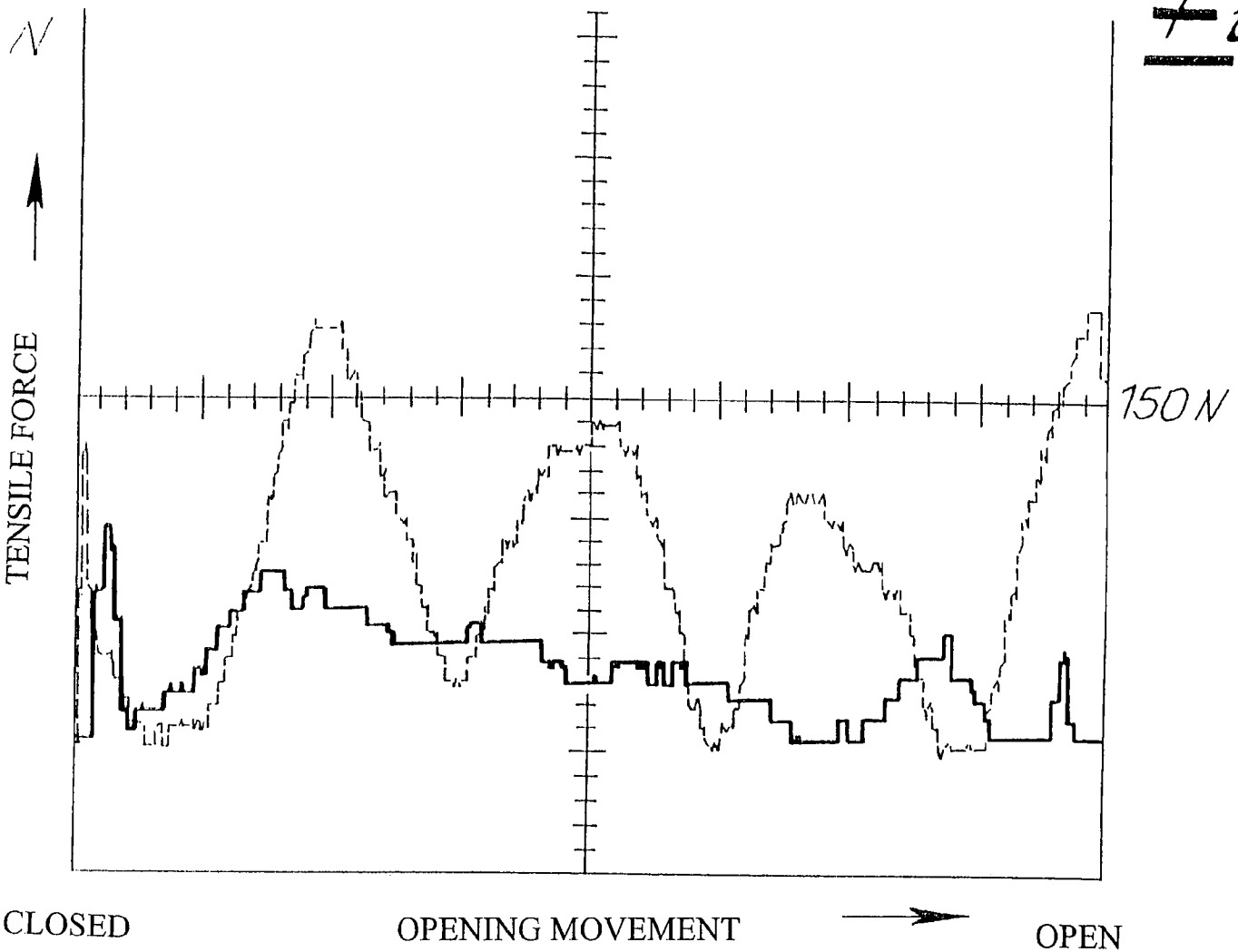
FIG. 2 is a force diagram of the tensile force measured during an opening movement of a sectional door.

FIG. 2 shows a graph of the tensile force that acts on the door panel during an opening movement of the door panel. The progression indicated with a broken line shows measurement values for a sectional door having a door drive configured as a ceiling-mounted pulling mechanism, according to the state of the art, which is connected with the section of the door panel that is uppermost in the closed position. The measurement values for a sectional door having a door drive according to the invention, at the lowermost section, are shown with a thicker, solid line. A comparison of the measurement values makes it clear that the arrangement according to the invention makes it possible to clearly reduce the forces for a movement of the door panel, that lower variations in force occur during the movement of the door panel, and that a safe distance from the maximal static force of 150 N that is permissible according to the European standard EN 12453: 2000 is maintained.

Figure 4:
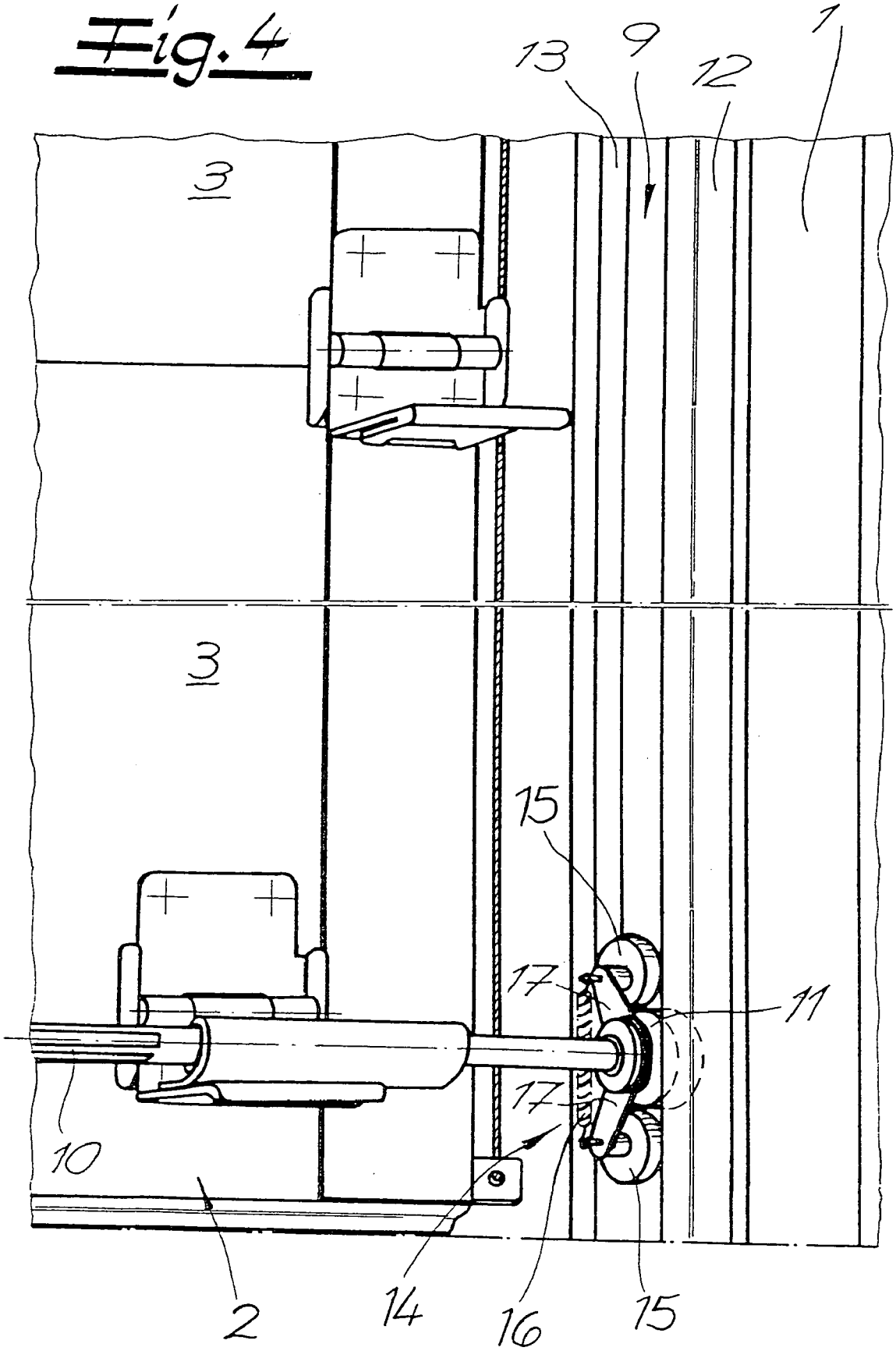
FIG. 4 is a detail of the device according to the invention.

Guide rails 9 possess a C-shaped cross-sectional profile, whereby one shank of the profile is configured as a groove-shaped running surface 12 and the other shank forms a support surface 13 arranged at a distance from the running surface. It is evident from FIG. 4 that a spring-loaded tensioning device 14 having at least one pressure roller 15 supported on support surface 13 is arranged at the end of power take-off shaft 10, which presses driven impeller 11 against running surface 12 of guide rail 9. In the embodiment, tensioning device 14 comprises two pivot arms 17 mounted to rotate about power take-off shaft 10, and connected by means of a tension spring 16, whereby a pressure roller 15 is arranged on pivot arms 17, in each instance.

Figure 5:
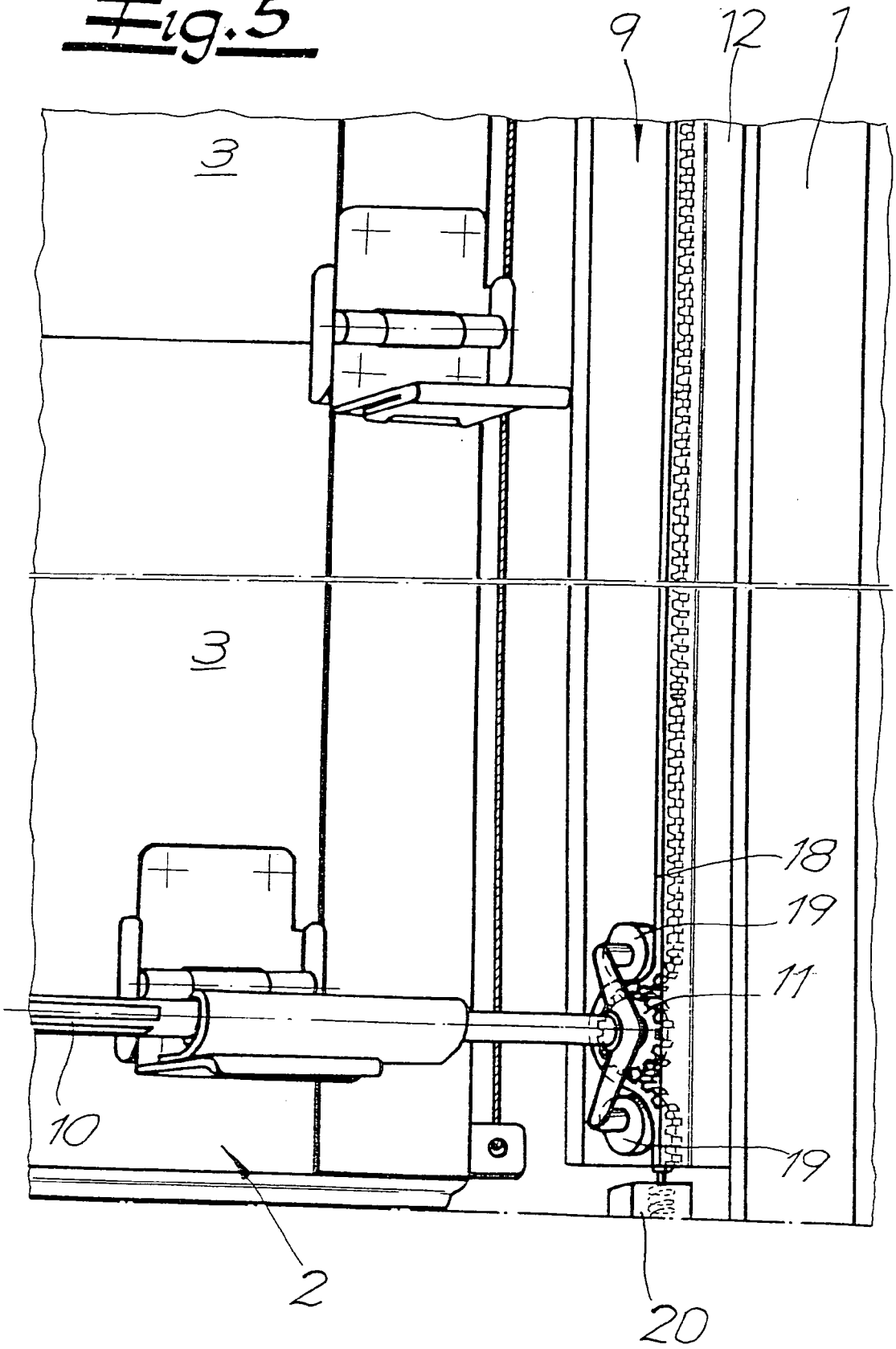
FIG. 5 is another embodiment of the arrangement according to the invention, also in detail.
Figure 6:
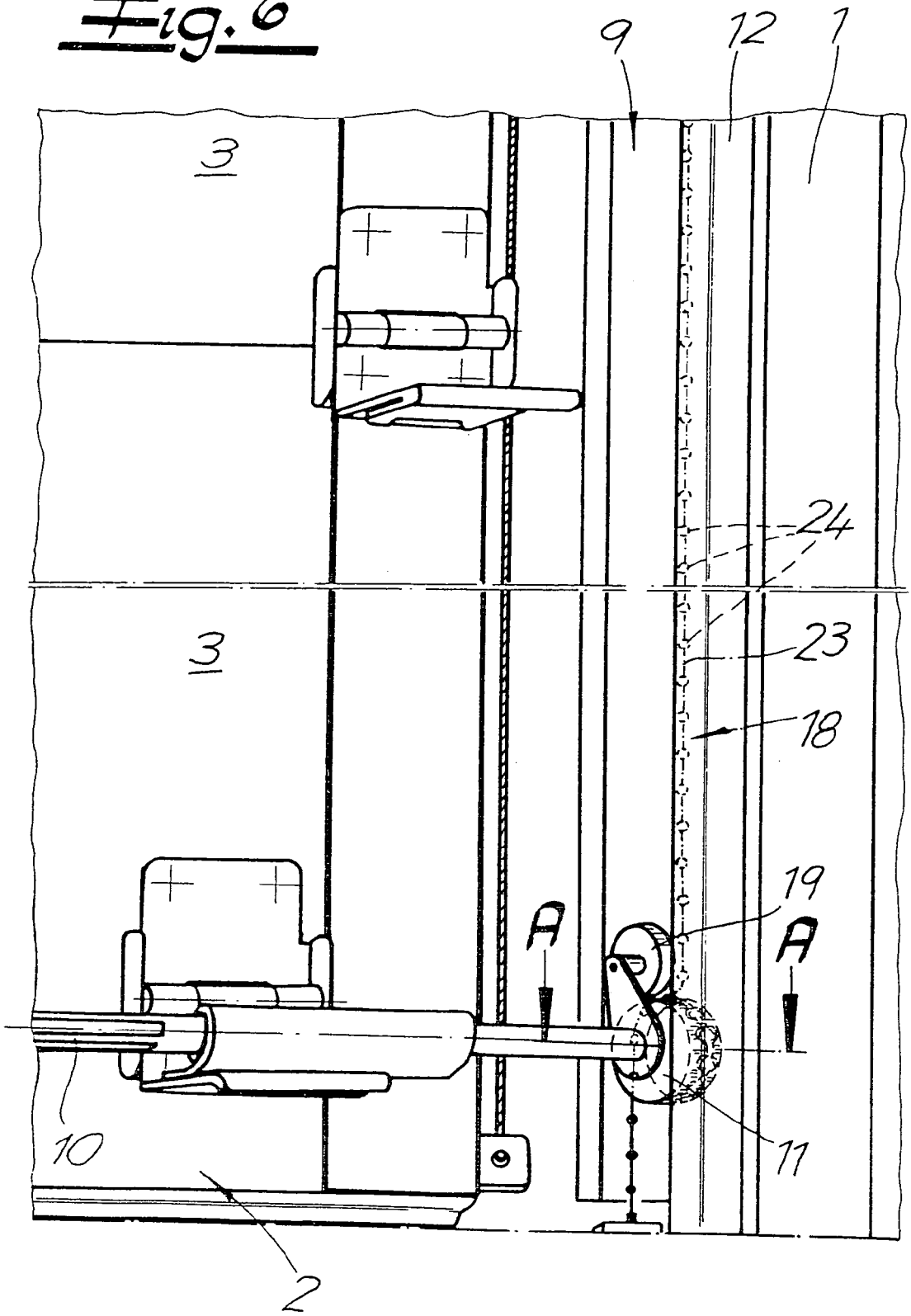
FIG. 6 is another embodiment of the arrangement according to the invention, also in detail.
Figure 7:
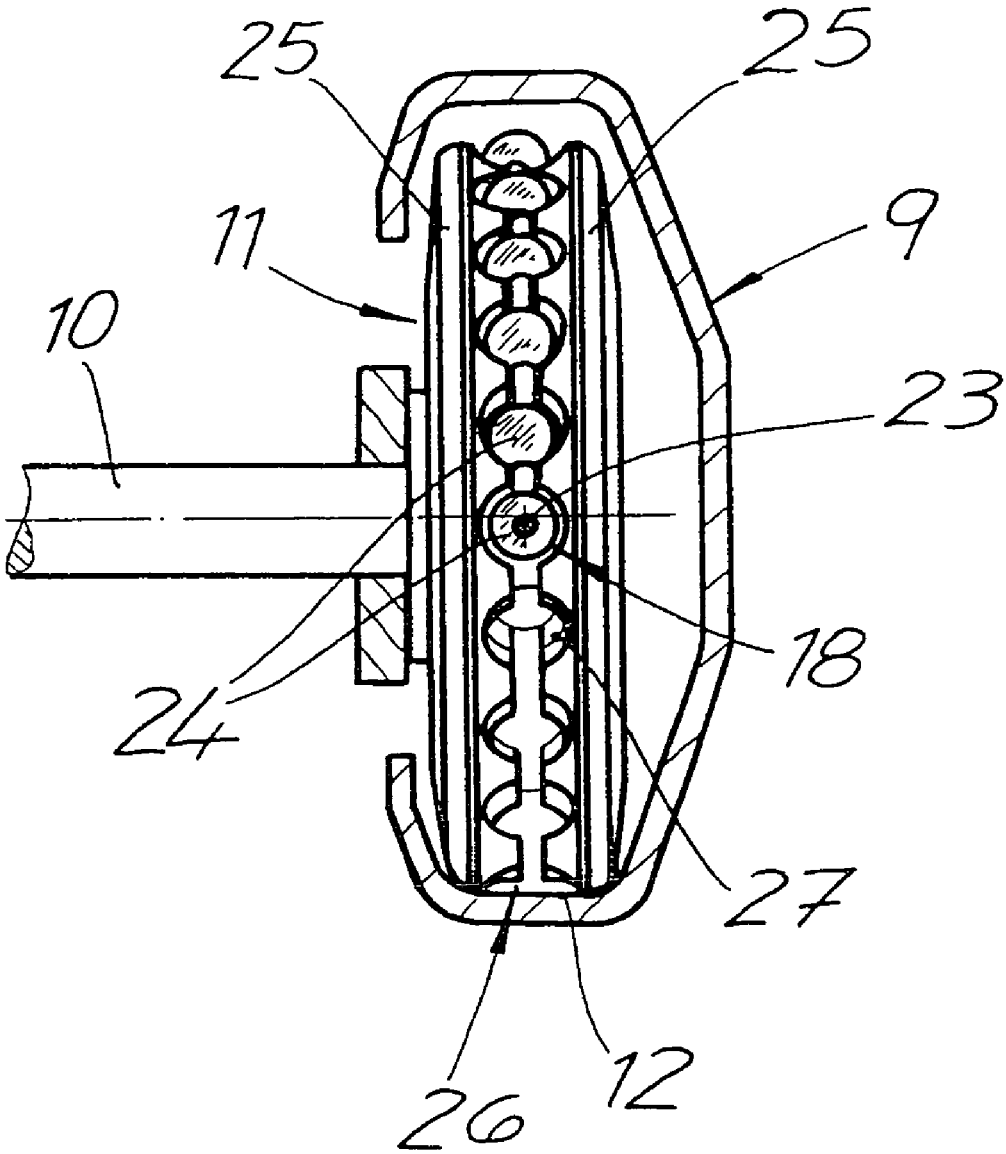
FIG. 7 is the cross-section A-A in FIG. 6.

In the embodiments of FIGS. 5-7, driven impeller 11 works together with a flexible power transmission train 18 that is held under tension in guide rail 9.

In FIG. 5, driven impeller is configured as a pinion, which meshes with a power transmission train 18 configured as a toothed belt. Toothed belt 18 partly loops around pinion 11. There are guide rollers 19 disposed in the running direction in front of and behind the pinion. These guide rollers run on the back of toothed belt 18, as do the rollers 8 of the other sections 3. Toothed belt 18, which is under tension, transfers the forces that are required for the opening and closing movements. To tension toothed belt 18, a tensioning station 20 is disposed at its one end.

In FIG. 6, power transmission train 18 is structured as a bead chain that comprises a core 23 and a plurality of bodies 24 attached to core 23 at equal intervals. Driven impeller 11 has a U-shaped running surface 26 delimited by side flanks 25, which contains depressions 27 adapted to bodies 24 of bead chain 18 in the bottom of the running surface (see FIG. 7). In this exemplary embodiment, only one guide roller 19 is disposed in front of driven impeller 11, seen in the opening movement direction, so that bead chain 18 loops around driven impeller 11 in Z shape. To maintain the tension during an opening and closing movement of the door panel 2, tensioning stations are disposed at both ends of bead chain 18.

Accordingly, while a few embodiments of the present invention have been shown and described, it is to be understood that many changes and modifications may be made thereunto without departing from the spirit and scope of the invention as defined in the appended claims.

What is claimed is:

1. A sectional door comprising a) a door frame;

b) a door panel comprising a plurality of sections coupled to one another in an articulated manner;

c) a weight equalization device coupled to said door panel;

d) an electrical door drive coupled to said door panel for opening and closing movements of the door panel;

e) a plurality of running rails; and f) a plurality of guide rails coupled to said frame;

wherein said plurality of sections include an uppermost section, which in a closed position of said door panel, is guided on said plurality of running rails as a header section, wherein said plurality of running rails extend essentially horizontally up to said door frame, and have a vertical end segment on a frame side, and wherein any other sections of said door panel that follow below said header section are guided in said plurality of guide rails that have a vertical segment along said door frame, a horizontal segment parallel to said running rail that holds said header section, as well as an arc that joins two of said segments, wherein said door drive is attached to one of said sections that is lowermost in said closed position of said door panel, and has at least one power take-off shaft mounted on said at least one section, with an impeller at the end of said power take-off shaft, and wherein said driven impeller engages in said guide rails for said sections and moves said door panel along said guide rails and is pressed against a running surface of said guide rail to move said door panel along said guide rails.

2. The sectional door according to claim 1, wherein said door drive is designed so that a maximal drive force for moving said door panel is not more than 150 N.

3. The sectional door according to claim 1, wherein said door drive has two power take off shafts and has a bifurcation gear mechanism for said two power take-off shafts that extend to both sides of an attached section and wherein said door drive has at least one impeller that engages in said guide rails at their ends.

4. A sectional door comprising a) a door frame;

b) a door panel comprising a plurality of sections coupled to one another in an articulated manner;

c) a weight equalization device coupled to said door panel;

d) an electrical door drive coupled to said door panel for opening and closing movements of said door panel;

e) a plurality of running rails; and f) a plurality of guide rails coupled to said frame, wherein said plurality of sections include an uppermost section, which in a closed position of the door panel, is guided on said plurality of running rails as a header section, wherein said plurality of running rails extend essentially horizontally up to said door frame, and have a vertical end segment on a frame side, and wherein any other sections of said door panel that follow below said header section are guided in said plurality of guide rails that have a vertical segment along said door frame, a horizontal segment parallel to said running rail that holds said header section, as well as an arc that joins two of said segments, wherein said door drive is attached to at least one of said sections connected below said header section that is lowermost in a closed position of said door panel, and has at least one power take-off shaft mounted on said at least one section, with an impeller at the end of said power take-off shaft, and wherein said driven impeller engages in one of said guide rails and is pressed against a power transmission train to move said door panel along said guide rails.

5. The sectional door according to claim 4, wherein said door drive is designated so that a maximal drive force for moving said door panel is not more than 150 N.

6. The sectional door according to claim 4, wherein said door drive has two power take off shafts and has a bifurcation gear mechanism for said two power take-off shafts that extend to both sides of an attached section and wherein said door drive has at least one impeller that engages in said guide rails at their end.

* * * * *